US006694524B2

(12) United States Patent
Azu

(10) Patent No.: US 6,694,524 B2
(45) Date of Patent: Feb. 24, 2004

(54) HAIR AND GARMENT PROTECTOR

(76) Inventor: Clarissa A. Azu, 27 Hamilton Rd., Thornton Heath, Surrey CR7 8NN (GB)

( * ) Notice: Subject to any disclaimer, the term of this patent is extended or adjusted under 35 U.S.C. 154(b) by 0 days.

(21) Appl. No.: 10/193,373

(22) Filed: Jul. 11, 2002

(65) Prior Publication Data

US 2003/0009815 A1 Jan. 16, 2003

(51) Int. Cl.[7] ..... A42B 1/04
(52) U.S. Cl. ..... 2/174
(58) Field of Search ..... 2/9, 174, 202, 2/205, 206, 4

(56) References Cited

U.S. PATENT DOCUMENTS

| | | | | | |
|---|---|---|---|---|---|
| 2,249,734 | A | * | 7/1941 | Tate et al. | 2/174 |
| 2,445,487 | A | * | 7/1948 | Lesser et al. | 2/174 |
| 2,447,561 | A | * | 8/1948 | Brenner | 2/174 |
| 2,477,437 | A | * | 7/1949 | Borowick | 2/174 |
| 4,457,027 | A | * | 7/1984 | Gladstone | 2/174 |
| 4,698,853 | A | * | 10/1987 | Walton | 2/174 |
| 4,887,316 | A | * | 12/1989 | Morandini | 2/174 |

OTHER PUBLICATIONS

"Self–Adhering Nylon Tapes", Journal of American Medical Assn. (J.A.M.A), vol. 168, No. 7, Oct. 18, 1958, p. 930.*
Merriam Webster's Dictionary, 10th Edition, p. 557.*

* cited by examiner

*Primary Examiner*—Tejash Patel
(74) *Attorney, Agent, or Firm*—Jeffrey K. Seto

(57) ABSTRACT

A device for preventing make-up and other materials from rubbing off onto sweaters and garments that are tried on by customers before being purchased. The present protection device is in the shape of a hood that covers the entire head, including the face, of a wearer. The protection device includes a rigid support in the back and an inexpensive semi-transparent material in the front. The rigid support provides structure to the protection device making it easy to handle, protects the hair of the wearer, and prevents hair gel and other material from being transferred to garments. The semi-transparent material in the front allows the user to breathe and still be able to see, so the wearer can locate armholes and other important areas of the garment. Attachment straps are used to secure the device in place around the wearer's head. The present hair and garment protector is preferably made of inexpensive materials so that the protector can be a disposable device.

8 Claims, 2 Drawing Sheets

HAIR AND GARMENT PROTECTOR

BACKGROUND OF THE INVENTION

This application was originally filed as United Kingdom Patent Application No. 0117046.3, on Jul. 12, 2001. Priority is hereby claimed to that U.K. application.

The present invention relates generally to the field of clothing sales and more specifically to a device that prevents materials on a person's head and face from coming in contact with articles of clothing that are slipped on over the person's head.

In traditional shopping situations, customers try clothes on, to check for fit and appearance, before buying them to ensure that the article of clothing meets their needs. However, for clothing items that must be slipped over the customer's head, such as sweaters, this can lead to soiling of the clothing item. Sweaters and other items can be soiled by material from the customer's head such as make-up and hair gel. After such soiling occurs, subsequent potential buyers are often reluctant to buy the garment because of the presence of cosmetics, or other matter, from the head of a shopper who has previously tried on the garment.

Such a problem could be avoided if potential purchasers used a hair and garment protector to prevent the article of clothing from coming into contact with any cosmetic, make-up, or hair care product, such as hair gel, they may be wearing. In this way the garment would remain clean and suitable for inspection and possible purchase by another shopper. There are a number of mask type protectors that are generally shaped to only cover a user's mouth and nose. These protectors are typically used for industrial and medical purposes, for example as dust masks or to prevent the spreading of infection. Such masks rely on a tight seal being formed between the protector and the wearer's face.

A particular requirement of these masks is that they are made from permeable materials to allow the wearer to breathe normally, in spite of the tight seal between the mask and face. The need for such an efficient permeable material requires that an advanced, and usually expensive, material be used. International Patent Application No. WO97/46123, for example, discloses a mask for use by health workers. The mask, which is adaptable to a user's mouth and nose, is not only permeable but also acts as a filter for small particles. International Patent Application No. WO98/28977 discloses a face protector, which is provided with adjustable loops for attachment to the ears of a user. This mask is further provided with a retaining band, which passes round the user's neck. These types of masks are designed for use in an industrial or health related environment. There is a lack of protector masks that can be used in environments where the formation of a seal between the user and the protector is not required. It is an object of the present invention to provide a hair and garment protector that mitigates the problem of cosmetics being rubbed from a face to an item of clothing.

SUMMARY OF THE INVENTION

A method for preventing cosmetic materials from being deposited on an article of clothing when a user slips the article of clothing on over their head. The method comprises, attaching and securing a barrier to the head of the user, maneuvering the article of clothing over the head of the user, and removing the barrier once the user's head has passed through the article of clothing. These steps are repeated when the user is ready to remove the article of clothing. The barrier is preferably similar to a hood that is worn over the user's head and also covers the user's face. The barrier can provide protection to the user's hair as well as to the garment that is tried on. At least a frontal portion of the barrier comprises a lightweight material that the user can see through, such as thinly woven cotton, tissue, and nylon. The barrier includes one or more straps that may use VELCRO type hook and loop material to secure the barrier around the head of the user.

It is an object of the present invention to prevent make-up, hair gel, and other substances on the head and face of a customer from soiling garments that the customer must slip on over their head in order to try on the garment.

It is a further object of the present invention to protect the hairstyle of the customer trying on the garment.

BRIEF DESCRIPTION OF THE DRAWINGS

The invention of the present application will now be described in more detail with reference to the accompanying drawings, given only by way of example, in which.

DETAILED DESCRIPTION OF THE INVENTION

Figure 1:
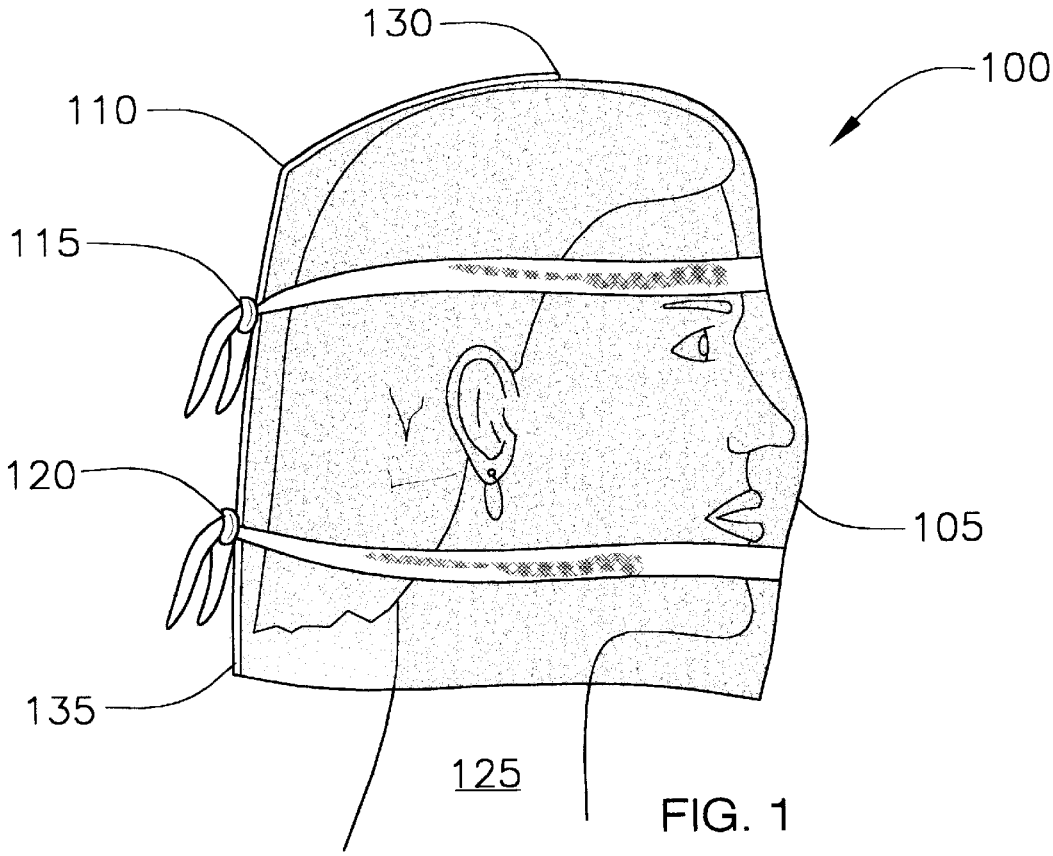
FIG. 1 is a side view of one embodiment of the present invention, in its operational position.

FIG. 1 shows the present hair and garment protection device 100 in its operational position, over the head of a customer at a clothing store, for example. Protection device 100 is worn as a hood that completely covers the entire head and face. However, the person wearing device 100 is still able to see and breathe because at least the frontal portion of the device is made of a lightweight see through and breathable material 105. Also, no part of device 100 forms a seal with the face of the wearer, so airflow within the device is not restricted. The see through material 105 is preferably provided in the portions of the device 100 that covers the front and at least of portion of both sides of the wearer's head. This allows a wearer that is about to slip a sweater on over her head, to still able to see and locate the armholes and the hole for her head in the sweater. The present device 100 forms a barrier around the customer's head that protects garments that the customer must slip on over their head from picking up any substances that are on the customer's head and face. Specifically, any material, such as make-up and hair gel, is prevented from rubbing off of the customer onto the garment.

The present protection device 100, also referred to as a protector or a barrier, uses a rigid support device 110 to provide structural support. Support device 110 is particularly helpful during attachment or securing of the protector. Support device 110 provides a partial framework for the protector and in the embodiment of FIG. 1 extends from a point 130 near the top of the wearer's head, along the back of the wearer's head to a point 135 below the head, near the neck of the wearer. Two sets of straps 115 and 120, or attachment devices, are provided for securing, or attaching, the device 100 around the wearer's head (in its operational position). In an alternative embodiment, straps 115 and 120 include VELCRO (registered trademark) type hook and loop material to aid in attachment around the wearer's head. This alternative embodiment is described further below in conjunction with FIG. 3.

Figure 2:
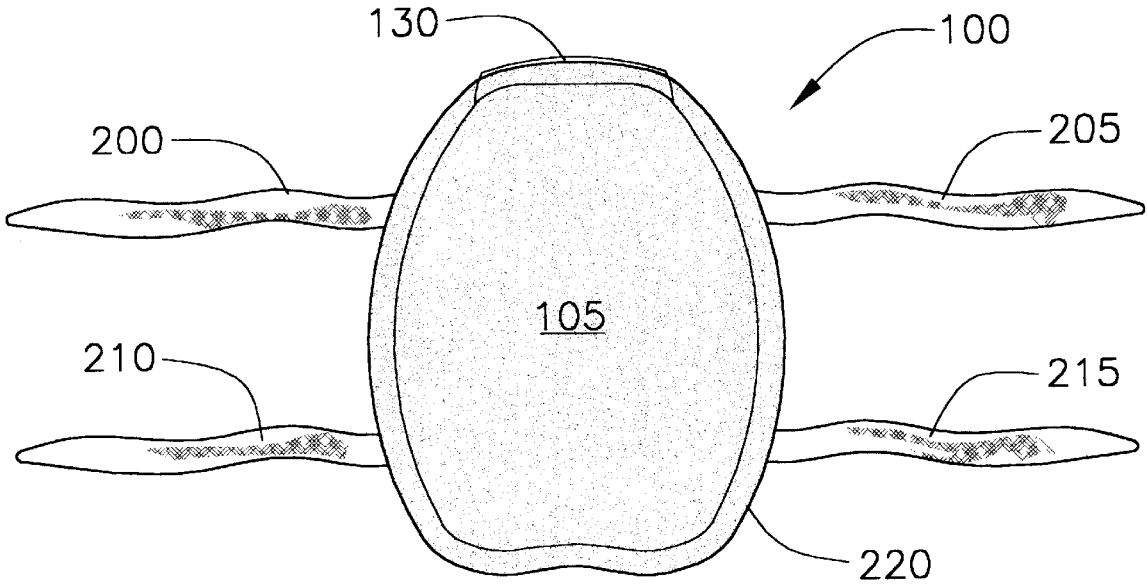
FIG. 2 is a frontal view of the same embodiment.

FIG. 2 shows a frontal view of the preferred embodiment 100. The top of the rigid support device 130 can be seen at the top of protector 100 in FIG. 2. The presence of the support device imparts an element of rigidity on the hair and garment protector and makes it easier to use. The frontal portion of protector 100 is made of a semi-transparent material 105, as discussed above. Material 105 can be made of many different materials, and preferably is made of an inexpensive material that allows the protector 100 to used as a disposable item. The outer edges of material 105 is generally defined by 220 in FIG. 2. In use the hair and garment protector 100 is placed over a user's head and secured using the attachment means. In the embodiment of FIG. 2, the attachment means comprises upper straps 200 and 205, and lower straps 210 and 215. When the protector is in place, the user can pull garments over their head without depositing any cosmetic or other material on the garment.

Figure 3:
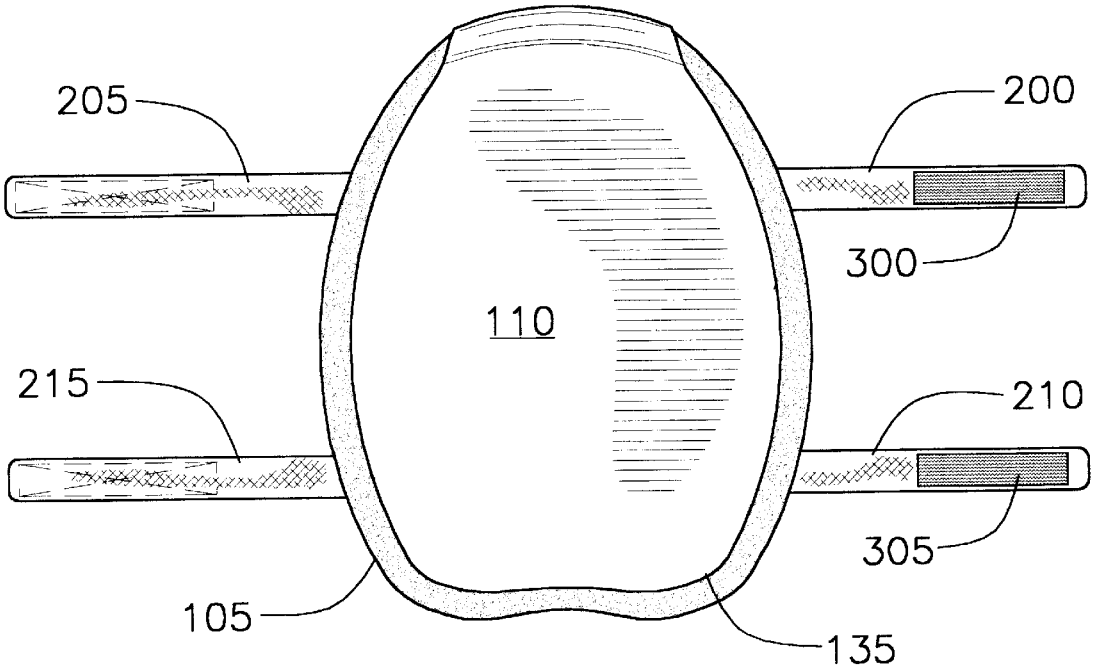
FIG. 3 is a back view of an alternative embodiment.

FIG. 3 illustrates the back view of an alternative hair and garment protector embodiment. In this embodiment, upper strap 200 and lower strap 210 each include a strip of VELCRO type hook and loon material. Complementary strips of VELCRO type hook and loon material are also provided on upper strap 205 and lower strap 215. Each strap is made of a flexible material that is wrapped around the head of the wearer and secured by connecting the complementary VELCRO type hook and loon material strips. Rigid support device 110 covers the back of the wearer's head and a portion of the top of the wearers head. Support device 110 extends down to a level that is below the back of the wearer's head shown by reference number 135. Rigid support 110 provides structural shape to the protector, provides protection for the wearers hair, and makes the present protector easier to handle and use. The outline of see through material 105, which covers the front of the protector, can also be seen in FIG. 3.

The foregoing description of the specific embodiments will so fully reveal the general nature of the invention that others can, by applying current knowledge, readily modify and/or adapt for various applications such specific embodiments without departing from the generic concept. Therefore, such adaptations and modifications should and are intended to be comprehended within the meaning and range of equivalents of the disclosed embodiments. It is to be understood that the phraseology of terminology employed herein is for the purpose of description and not of limitation.

I claim:

1. A method for preventing cosmetic materials from being deposited on an article of clothing when a user slips the article of clothing on over their head, the method comprising the steps of:

attaching and securing a barrier to the head of the user;

maneuvering the article of clothing over the head of the user;

removing the barrier once the user's head has passed through the article of clothing; and, repeating the steps of attaching, maneuvering, and removing, when the item of clothing is to be removed, wherein the barrier comprises a lightweight material in a front of the barrier that is at least partially see-through, including cotton and nylon, and a rigid support device in a back of the barrier that provides structural support.

2. The method of claim 1, wherein the barrier is a hair and garment protector that is worn over and around the user's head.

3. The method of claim 1, wherein the barrier includes one or more straps that are used to secure the barrier around the head of the user.

4. The method of claim 3, wherein the one or more straps use an attachment means, including hoop and loop material, for securing the barrier in an operational position.

5. A hair and garment protector for use as a barrier that prevents matter from a face or head of a user from getting on, and possibly staining, an article of clothing that the user slips on over their head, the hair and garment protector comprising:

a protective hood that covers the user's head and face; and, an attachment means for securing the hood around the user's head, wherein at least a frontal portion of the hood comprises a lightweight material that is at least partially see-through, including cotton and nylon, and a back portion of the hood comprises a rigid material that provides structural support to the protector.

6. The hair and garment protector of claim 5, wherein the protector is provided in multiple different sizes.

7. The protector of claim 5, wherein the attachment means comprises one or more straps that are used to secure the hood around the head of the user.

8. The protector of claim 5, wherein the attachment means includes hook and loop material for securing the hood in an operational position.

* * * * *